United States Patent [19]

Olivenbaum et al.

[11] Patent Number: 4,931,976

[45] Date of Patent: Jun. 5, 1990

[54] TEMPERATURE COMPENSATED SIDE LOBE SUPPRESSION

[75] Inventors: James E. Olivenbaum, Houston; Mark C. Fischer, Pasadena, both of Tex.

[73] Assignee: Tideland Signal Corporation, Houston, Tex.

[21] Appl. No.: 266,560

[22] Filed: Nov. 3, 1988

[51] Int. Cl.[5] ..... H01Q 3/26

[52] U.S. Cl. ..... 364/571.04; 364/571.03; 342/173

[58] Field of Search ..... 364/571.07, 571.04, 364/571.03; 342/173, 172, 165

[56] References Cited

U.S. PATENT DOCUMENTS

| | | | |
|---|---|---|---|
| H000,173 | 12/1986 | Claborn et al. | 342/372 |
| 4,437,164 | 3/1984 | Branch, III | 364/571.07 |
| 4,592,002 | 5/1986 | Bozarth, Jr. et al. | 364/571.03 |
| 4,633,422 | 12/1986 | Brauer | 364/571.07 |

*Primary Examiner*—Parshotam S. Lall
*Assistant Examiner*—S. A. Melnick
*Attorney, Agent, or Firm*—Fulbright & Jaworski

[57] ABSTRACT

An improved side lobe suppression circuit in a racon for determining frequency band edge. As the temperature varies, a temperature frequency calibration table receives a temperature measurement and determines which frequencies are out of band as the temperature varies. A microprocessor changes the threshold values in a ram in response to temperature changes to suppress out of band frequencies but to allow the transmission of in band frequencies above a predetermined threshold.

6 Claims, 2 Drawing Sheets

TEMPERATURE COMPENSATED SIDE LOBE SUPPRESSION

BACKGROUND OF THE INVENTION

A marine radar beacon (racon) is a microwave transmitter which receives a radar pulse from a ship and provides a reply signal which locates and identifies the racon. Side lobe suppression refers to the capability of the racon to distinguish between the main lobe of the received signal and its low level side lobes in order to deny a response to the radar side lobes. A side lobe suppression circuit operates by storing threshold values in a side lobe suppression memory. This results in much less clutter, or false responses, being displayed on the radar screen. For input signals below this threshold, no transmission will occur, but for input signals above the threshold, the racon will transmit replies within a desired transmission band. However, the frequency edge band between in band and out of band frequencies is subject to temperature drift because of the dielectric properties of the frequency detection means.

The present invention is directed to determining frequency band edges as temperature varies and changing the frequency band transmissions in response to temperature variations.

SUMMARY

The present invention is directed to a racon having a sensor with frequency, pulse width, and amplitude measuring means for measuring amplitude and frequency values. An improvement is provided in a side lobe suppression circuit for correcting frequency band transmissions as the temperature of the sensor varies. The circuit includes temperature measuring means connected to and measuring the temperature of the sensor and a means connected to and digitizing the outputs of the temperature measuring means, the frequency measuring means and the amplitude measuring means. A side lobe suppression memory RAM is connected to the digitizing means for receiving the frequency measurement and the RAM has an output providing a threshold value in response to the frequency input. A comparator is connected to the output of the RAM for receiving a threshold value and is also connected to the digitizing means for receiving the amplitude measurement and the comparator provides an output response if the amplitude is greater than the threshold value. A microprocessor is connected to the digitizing means for receiving the temperature measurement and is also connected to a temperature-frequency calibration table for determining band edges as the temperature varies. The microprocessor changes the threshold values in the RAM of the frequencies in response to temperature changes.

Still a further object is wherein the microprocessor increases the threshold values of frequencies which are out of band for inhibiting those frequencies and decreases the threshold values of frequencies which become in band for transmitting these frequencies.

Still a further object is wherein the digitizing means is an analog to digital converter and a multiplexer is connected between the converter and the temperature measuring means, the frequency measuring means and the amplitude measuring means.

Yet a further object to the present invention is wherein the RAM includes stored threshold values stored in the RAM in preferably hexadecimal form using the lower seven bits of an eight bit binary number, and the microprocessor inhibits an out of band frequency by adding a one to the most significant bit, but changes the one to a zero for an in band frequency.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
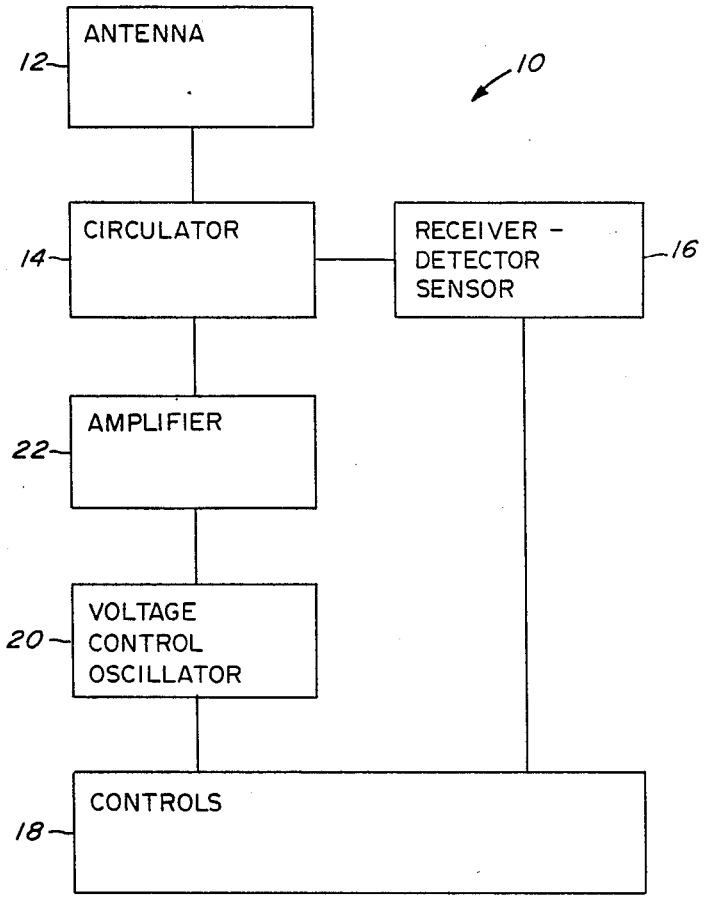
FIG. 1 is a block diagram of a conventional marine radar beacon system.

Referring now to the drawings, and particularly to FIG. 1, the reference numeral 10 generally indicates a block diagram of a racon. Racons generally have an X-band and an S-band system, only one of which will be described. The system 10 includes an antenna 12 for receiving interrogating radar pulses and for providing a return transmission. When a radar signal is received from a ship by the antenna 12, it is transmitted to a circulator 14 and then directed to a receiver or sensor 16 for measuring the amplitude and frequency of the received radar signal. The received signal 16 is transmitted to controls 18 which measure the received signal and then generate a reply signal at the same frequency as the received signal. The transmitted signal is generated by a voltage control oscillator 20, amplified by amplifier 22, and sent through the circulator 14 to the antenna 12 for transmission. The frequency control loop is closed by measuring the transmitted frequency using the detector 16 and thereafter controlling the frequency of the reply signal in an attempt to keep it equal to the frequency of the received signal.

The controls 18 include a side lobe suppression circuit which distinguishes between the main lobe and its low level side lobes for preventing transmission of the racon 10 in response to radar side lobes. The side lobe suppression circuit also functions to allow transmission of replY signals which are in band with the received signals, but inhibits out of band transmissions. However, the frequency band edge between in band and out of band is subject to temperature drift because of the dielectric properties of the frequency detection means in the receiver frequency detector 16. The present invention is directed to a side lobe suppression circuit for correcting the frequency band edge determining circuitry as the temperature of the measuring sensor varies.

Figure 2:
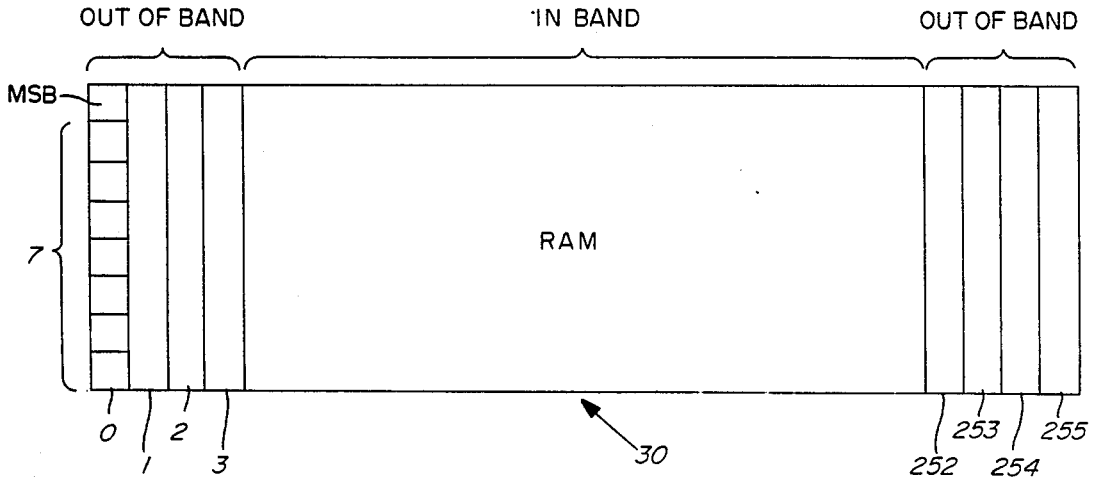
FIG. 2 is a memory map of the side lobe suppression memory RAM.

For purposes of illustration only, the theory of the present invention is best understood by referring to FIG. 2 of the present invention which schematically represents the side lobe suppression memory RAM 30 of the present invention which is a commercially available integrated circuit memory device. For example only, it has addresses 0 through 255. For example only, using the hexadecimal base, a threshold value may be provided in each of the 255 addresses between 0 and FF at each location. That is, using the hexadecimal base, an eight bit binary number may be inserted in each of the 256 addresses. Referring to address 0, an eight bit binary number may be located with a value between 0 and FF. However, by using only the lower seven bits, a value of up to hex 3F can be inserted. This uses the lower seven bits of the eight bit binary number to set the threshold value of the incoming signal at a given frequency. If the signal coming in has a value above the set threshold the racon 10 will respond and thus transmit a reply signal. However, if the incoming signal value is below the inserted threshold, the racon will not respond. In summarY, a value for threshold is inserted in each of the addresses in the lower seven bits, and if the threshold number that is in each location is greater than the incoming signal at that location, the racon does not transmit. However, a reply transmission may include in the 256 addresses, an in band transmission and out of band transmission. For example, as shown in FIG. 2, addresses 0, 1, 2, 3, 252, 253, 254 and 255 are out of band and thus no reply transmission is desired at these addresses. The remainder of the center addresses are in band. However, as previously mentioned, the frequency measurement is a function of temperature. Therefore the frequency band edges which determine whether the channels or addresses are in band or out of band depend upon the temperature.

As previously indicated, the threshold value for each address is set in the lower seven bits L7 in FIG. 2. If we add a 1 in the most significant digit MSB, this would be much greater than the largest threshold value set in the lower seven digits. Therefore, by writing a 1 in the most significant digit MSB, transmission in that location will be inhibited. Using the RAM 30, a 1 can be inserted at the most significant digit MSB for those frequencies that are out of band and a 0 can be provided at those locations which are in band. Therefore, the present invention is directed to inserting a 1 or a 0 in the most significant digit MSB at each location upon temperature variations.

Figure 3:
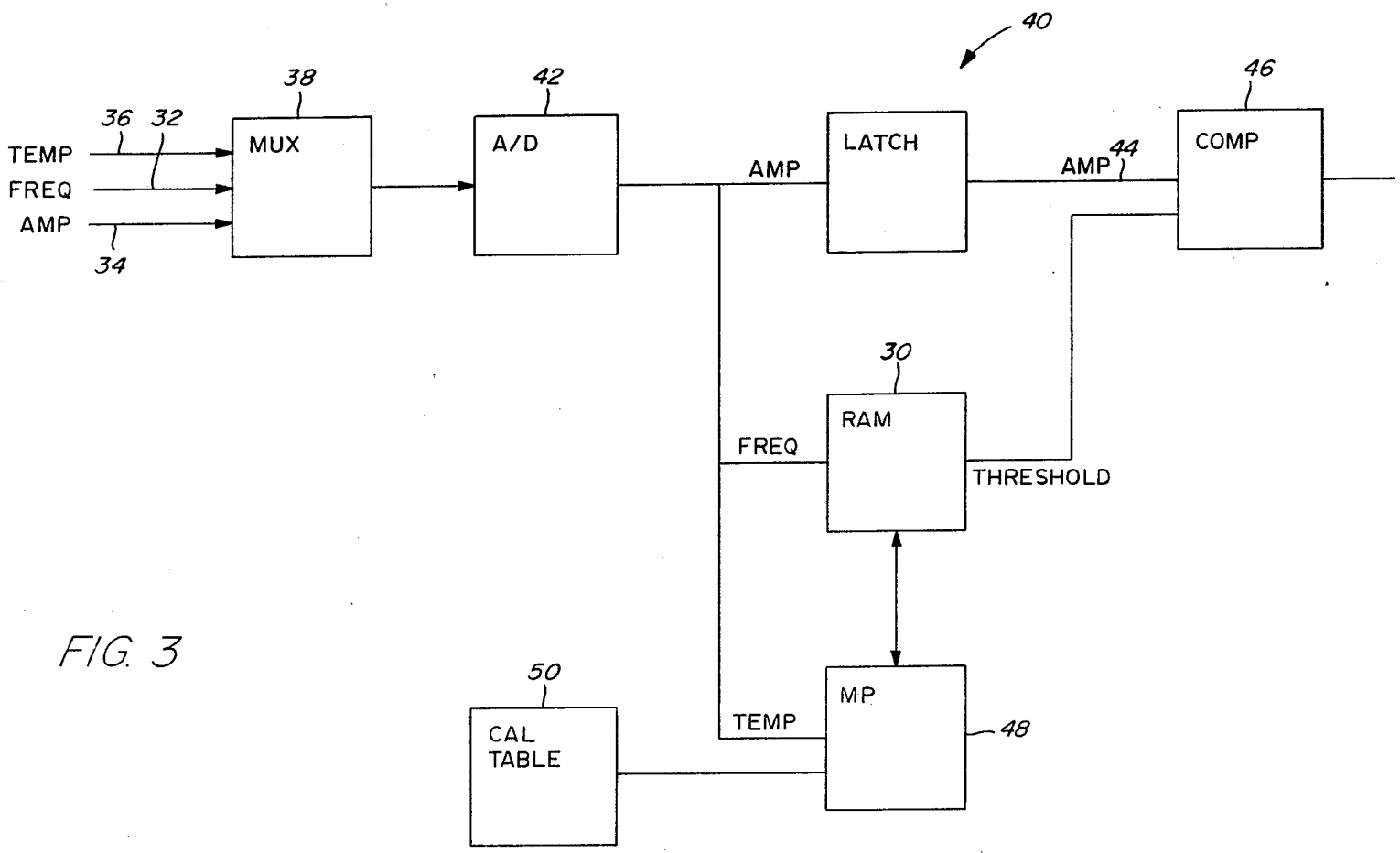
FIG. 3 is a block diagram of the temperature compensated side lobe suppression circuit of the present invention.

Referring now to FIG. 3, the side lobe suppression circuit is generally indicated by the reference numeral 40 and the detector or sensor 16 (FIG. 1) provides a frequency measurement 32 and an amplitude measurement 34. In addition, a temperature measurement 36 is provided of the detector 16. The input signals 32, 34 and 36 are transmitted to a multiplexer 38 and to a digitizing means such as an analog to digital converter 42. The amplitude signal is transmitted to one input 44 of a comparator 46. The digitized frequency signal is transmitted to the input of the RAM 30, and the digitized temperature signal is transmitted to a microprocessor 48. In addition, the microprocessor is connected to a calibration table 50, which may be software or hardware, for providing a relationship between frequency and temperature. As previously described, the RAM 30 is provided with a threshold value at each of its addresses for each of the inputted frequency signals. This threshold information is stored in the lower seven bits of resolution up to a maximum value of hex 7F. As to those frequencies which are in band, a 0 is entered into the most significant digit MSB and to those frequencies which are out of band the digit 1 is inserted into the most significant digit MSB. Since a 1 in the most significant digit changes the threshold at that address to a hex 80 or greater, transmission at that frequency address is inhibited.

However, the temperature of the sensor 16 may change thereby changing the measured frequency signal 32. The temperature signal 36 is transmitted to the microprocessor 48 and the temperature-frequency calibration table 50 provides a signal to the microprocessor to determine whether the measured frequency is now in band or out of band. If the frequency is calibrated to be out of band, the microprocessor changes the threshold values of the frequency in the RAM 30 to respond to temperature changes. That is, microprocessor 48 increases the threshold values of frequencies which now become out of band for inhibiting said frequencies and decreases the threshold values of frequencies which become in band. For example, when the threshold values stored in the RAM 30 are in hexadecimal form using the lower seven bits of an eight bit binary number for the threshold, the microprocessor inhibits an out of band frequency by adding a 1 to the most significant digit MSB. However, for frequencies which change from out of band to in band, the microprocessor 48 changes the 1 at the most significant bit to 0.

Therefore, in normal operation the side lobe suppression memory RAM 30 is provided with stored threshold values below which no transmission of the racon 10 can occur. However, as the temperature changes, the band edges may change to become in band or out of band and the threshold values in the RAM 30 are changed accordingly.

While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In a racon having a receiver-detector sensor with frequency and amplitude measuring means for measuring amplitude and frequency of a received radar signal and providing analog outputs, the improvement in a radar side lobe suppression circuit for automatically changing frequency band limits as the temperature of the receiver-detector-sensor varies comprising, temperature measuring means connected to and measuring the temperature of the receiver-detector-sensor and providing an analog output, means connected to and providing digital outputs representative of the analog outputs of said temperature measuring means, the frequency measuring means, and the amplitude measuring means, a radar side lobe suppression memory RAM connected to the digital outputs representative of the frequency and amplitude measurements, said RAM having an output providing a threshold value representative of prior amplitude measurement in response to the frequency input, a comparator having a first and second input, said first input connected to the output of the RAM for receiving the threshold value and said second input connected to the digital output representative of the presently received radar signal amplitude measurement, said comparator providing a response if the present amplitude is greater than the threshold value, a microprocessor connected to the digital output representative of the temperature measurement, a memory storage means containing a predefined temperature frequency calibration table and connected to the microprocessor for determining band edges as a function of temperature, and said microprocessor connected to said RAM for changing the threshold values stored in said RAM for the purposes of inhibiting out of band and enabling in band frequency transmission of the racon.

2. The circuit of claim 1 wherein the micro processor increases the threshold values in the RAM representative of frequencies which become out of band for the purpose of inhibiting a response from the comparator, and decreases the threshold values in the RAM representative of frequencies which become in band for the purpose of allowing a response from the comparator.

3. The circuit of claim 1 wherein the means for providing digital outputs is an analog to digital converter.

4. The circuit of claim 3 including, a multiplexer connected between the input of the converter and the analog outputs of the temperature measuring means, the frequency measuring means, and the amplitude measuring means.

5. The circuit of claim 1 wherein said RAM includes stored threshold values representative of prior received radar signal amplitudes as a function of frequency and said microprocessor, utilizing said calibration table, automatically modifies as the temperature changes the threshold values corresponding to out of band frequencies such that each threshold value is greater than the amplitude of a received out of band signal.

6. The circuit of claim 5 wherein the threshold values stored in the RAM use the lower seven bits of an eight bit binary number, and the microprocessor inhibits an out of band transmission by the racon by adding a logic one to the most significant bit of said binary number, but changes that logic one to a logic zero for in band frequencies.

* * * * *